United States Patent [19]

Ryan

[11] 4,123,183

[45] Oct. 31, 1978

[54] GUIDEPOST FOR ROADWAYS AND THE LIKE

[76] Inventor: John E. Ryan, 18113 Mt. Washington St., Fountain Valley, Calif. 92708

[21] Appl. No.: 828,743

[22] Filed: Aug. 29, 1977

[51] Int. Cl.[2] ..... E01F 9/00

[52] U.S. Cl. ..... 404/10; 40/608; 256/1

[58] Field of Search ..... 404/10, 9; 256/1, 13.1; 40/125 H

[56] References Cited

U.S. PATENT DOCUMENTS

| | | | |
|---|---|---|---|
| 2,121,961 | 6/1938 | Gill | 404/10 |
| 3,212,415 | 10/1965 | Byrd | 404/10 |
| 3,371,647 | 3/1968 | Shopbell | 404/10 X |
| 3,380,428 | 4/1968 | Abrams | 404/10 X |
| 3,709,112 | 1/1973 | Ebinger | 404/10 |
| 3,799,686 | 3/1974 | Williams | 404/10 |

FOREIGN PATENT DOCUMENTS

| | | | |
|---|---|---|---|
| 748,595 | 12/1966 | Canada | 404/10 |
| 2,314,560 | 10/1974 | Fed. Rep. of Germany | 404/10 |

*Primary Examiner*—Nile C. Byers, Jr.
*Attorney, Agent, or Firm*—Francis X. LoJacono, Sr.

[57] ABSTRACT

A guidepost for roadways or the like comprising an elongated tubular member formed from a flexible plastic material having a substantially "T"-shaped, cross-sectional configuration throughout the length thereof, the forward or front wall being relatively flat across its face and integrally formed, with sinusoidal-shaped side walls and a semi-circular rear wall defining the base of the "T"-shaped configuration, the forward wall having affixed adjacent one end thereof a reflector member. The lower, inner tubular section includes a filler core to provide and maintain its cross section below the ground line, the lower terminating end of the guidepost including a base member defined by an annular flange member.

8 Claims, 6 Drawing Figures

FIG. 1
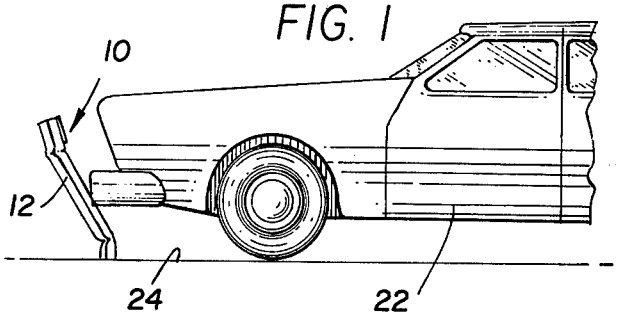
FIG. 2
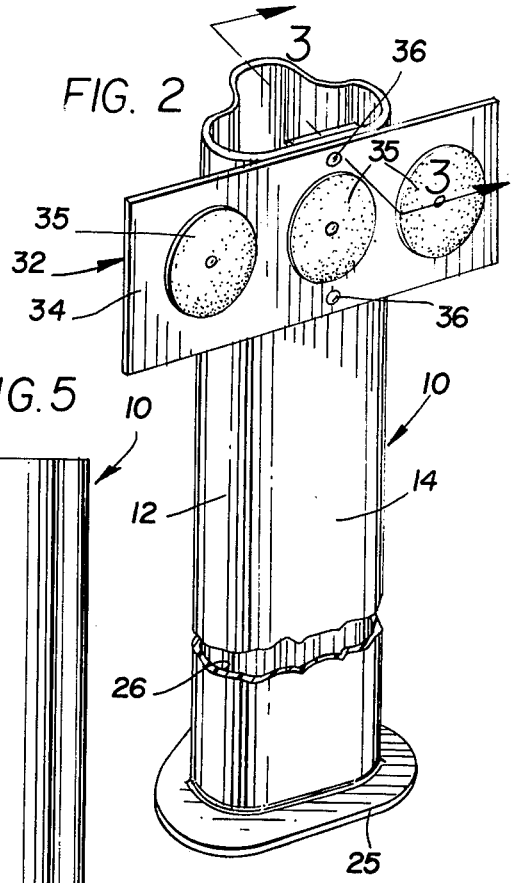
FIG. 3
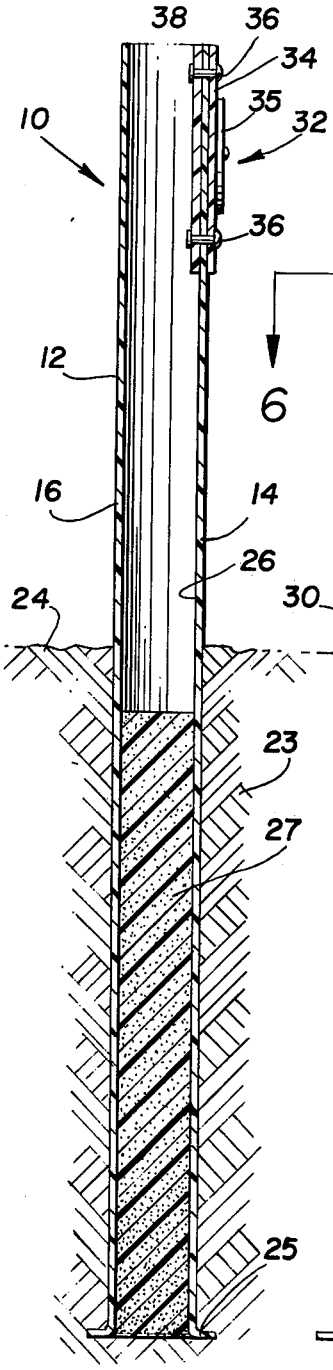
FIG. 4
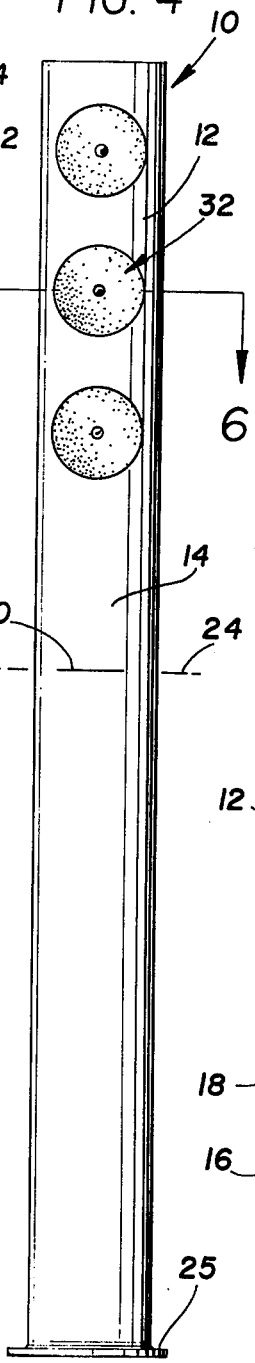
FIG. 5
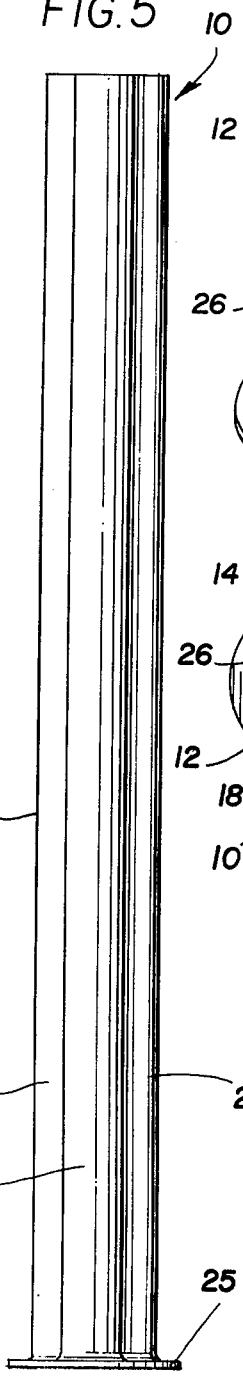
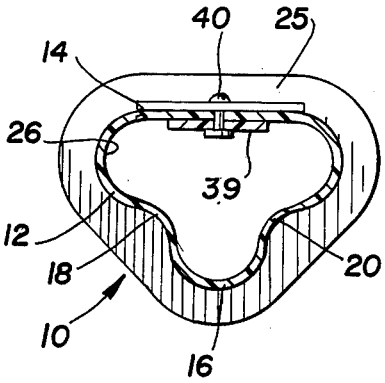
FIG. 6

GUIDEPOST FOR ROADWAYS AND THE LIKE

BACKGROUND OF THE INVENTION

1. Field of the Invention

This invention relates to a sign and a guidepost and, more particularly, to a sign and a guidepost that are generally located adjacent or on roadways and like areas traveled by vehicles.

2. Description of the Prior Art

As is well known in the art, various problems and difficulties are encountered in providing suitable posts for mounting road-reflective devices, particularly where the areas are located in or at high-risk areas. It is common practice to provide guideposts along the edges of roadways and other places where it is desirable to provide motorists with readily seen visual indications of the limits of the areas to be traversed by the vehicles.

Conventionally, these guideposts are made of metal, and have flat upper portions painted white; and are provided with glass or plastic reflectors to impart night visibility. It is a major expense to maintain these guideposts because, frequently, they are struck by passing vehicles and bent over so that they become useless. Normally, one blow from a vehicle is sufficient to damage a guidepost beyond repair, so that the entire unit must be replaced.

The damage is not limited to guideposts, because these metal members are solid enough to dent a vehicle when struck. Also, they have resilience so that, after being struck, they are first bent over and then whip back in the opposite direction. The latter movement frequently will cause the post to strike some portion of the vehicle before it has passed by, thereby causing additional damage.

Further problems caused by these guideposts are the vulnerability of their glass and plastic reflectors which are easily damaged — either by being struck by vehicles or through vandalism.

Other forms of guideposts have been tried and have also met with various problems. Some forms are made from elastic polyethylene wherein the post provides an elongated tubular body, some of these having circular or triangular cross-sectional shapes. However, due to these shapes, the useable life period for such forms has been found to be limited to approximately three or four strikes from vehicles. Weak areas at the bending point develop and again create a maintenance problem.

Thus, the known road guideposts still leave the unsolved problem of providing a reliable post having an extended life period, wherein the post can be struck repeatedly by vehicles, and yet will immediately return to an upright position. Thus, the present device as herein disclosed includes a novel cross-sectional configuration that answers the above problems.

SUMMARY OF THE INVENTION

The present invention provides an improved guidepost of greatly increased durability, and which does not cause damage to a vehicle that strikes it.

The guidepost of this invention includes a tubular member made of a plastic material having flexible qualities inherent within the material after being formed. The cross-sectional configuration of the elongated tubular post is formed in a substantially "T" shape and having a front or forward face wall that is substantially flat, both laterally and longitudinally. Side walls are integrally formed therewith having a sinusoidal form that terminates into a rear semi-circular wall, whereby an elongated body is defined having an inherent resilient memory factor. That is, due to the specific wall design, an improved plastic post is created wherein the post is firm in an erect position, and yet is readily allowed to bend when struck by a vehicle. The sinusoidal configuration of the side walls permits the complete bending of the tubular body just above ground level; and the memory inherent in the plastic-formed body causes the post to return to a normal erect or upright position, without undue stress to the material at its bending point as created in other post configurations.

The upper free end of the guidepost is arranged to have attached thereto a mounting plate having reflector means secured individually thereto, or to allow the reflector means to be secured directly to the front wall thereof.

At the lower end, which is disposed in the surrounding ground area, there is provided an outwardly turned annular-flange member which provides an anchor means. The lower half of the tubular bore is filled with a strengthening material, so as to prevent the surrounding earth material from collapsing the lower tubular section positioned below the ground line. Thus, the post will bend over just above ground level at impact; and it will slowly recover its original upright position due to the inherent memory provided by the material and configuration of the post.

This type of post may be struck numerous times before any permanent damage will occur. Each post is very securely retained in the supporting medium; and thus it will not be pulled out — even when hit by a vehicle traveling at high speed.

OBJECTS AND ADVANTAGES OF THE INVENTION

The present invention has for an important object a provision wherein a guidepost formed from a plastic material is provided with a unique "T"-shaped, cross-sectional configuration whereby an inherent memory of the material and design allows the post to be struck over a greater number of times, thus extending its working life period well over that of known devices.

It is another object of the invention to provide a guidepost that includes a substantially flat front-surface wall, and has side walls formed in a sinusoidal manner, whereby there is less stress in the bending process.

It is still another object of the invention to provide a guidepost of this type that is easy to service and maintain.

Still another object of the invention is to provide a device of this character that is relatively inexpensive to manufacture.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

FIG. 1 is a side-elevational view showing the deflection of the guidepost as it is being hit by a vehicle under high-speed impact;

FIG. 2 is a perspective view of the guidepost of this invention, and showing one form of reflector means attached thereto;

FIG. 3 is a longitudinal, cross-sectional view taken substantially along line 3—3, and showing the post mounted in a ground-surface medium;

FIG. 4 is a front-elevational view having another form of reflector means secured thereto;

FIG. 5 is a rear-elevational view thereof; and

FIG. 6 is an enlarged, cross-sectional view taken along line 6—6 of FIG. 4.

DESCRIPTION OF THE PREFERRED EMBODIMENT

Referring more particularly to the drawings, there is shown in FIG. 1 a guidepost, generally indicated at 10, defined by an elongated tubular body member 12 formed in a substantially "T"-shaped configuration when seen in cross-section, as shown in FIG. 6. Said body member 12 is designed to be readily produced by any suitable extrusion method, wherein the material thereof is a plastic having flexibility and a resistance to sunlight. It may be made from a combination of linear polyethylene and copolymers of polyethylene, together with a coloring agent (normally a whitener) and ultraviolet inhibitors. The general wall thickness is approximately one-eighth inch overall. Thus, when so constructed, the tubular body member 12 can be made to retain its strength and flexibility through extremes of ambient temperatures.

It is important to also note that the materials used herein are provided with an inherent memory as well. That is, once the material has been formed in a particular shape, it will slowly return to that shape after it has been altered — such as being bent over when struck by a vehicle.

The tubular body member 12 has, a stated, a substantially "T"-shaped cross-sectional configuration comprising a substantially flat-faced surface front wall 14 and a semi-circular rear wall 16, said front and rear walls being integrally connected by side walls 18 and 20, respectively. Said side walls 18 and 20 are so arranged as to have a sinusoidal cross-sectional configuration. The front portion of each side wall, which is formed contiguously with the front wall, is formed having a convexed shape and extends inwardly, forming a part of the head of said "T" formation. The second portion of the side walls is convex in shape and extends to the rear wall 16, this portion defining the base of the "T" configuration.

Hence, as the body is discharged from the extrusion die, the desired shape is formed. The forming of the tubular body in this manner provides numerous structural advantages over the art. First, there is produced a compressive stress in all of the walls; and, when the guidepost is in service, this stress allows the tubular body member to recover its longitudinal upright position after being struck by a passing vehicle. The improved recovery is characteristic of the sinusoidal side walls.

Accordingly, when the guidepost 10 is struck by a vehicle, such as 22 in FIG. 1, the post will simultaneously collapse and bend just above the ground level 24, indicated in FIG. 4. That is, as the impact force is applied to the post, the sinusoidal side walls 18 and 20 will collapse with an accordion effect (folding like bellows) as the well-defined bend occurs. Hence, it can be understood that a great amount of actual bending stress is eliminated, due to the accordion-like collapse of side walls 18 and 20.

The lower end of said tubular body 12 includes an annularly formed flange member 25 which serves to prevent body 12 from being pulled from the supporting medium (such as ground 23) surrounding said body when in service, as seen in FIG. 3.

Further, there is provided within the lower end of the tubular bore 26 a core material 27 which can be any suitably firm structural material, but more suitably a polyurethane foam of two to four pounds density, the core 27 being complementary to the configuration of bore 26. The core 27 is normally from twelve to eighteen inches long, extending from the lower end of body 12 at flange 25 to a point just below ground level 24. Thus, as seen in FIG. 3, the surface 24 of the ground or other medium 23, within which the post is buried, is spaced just above the upper end of core 27.

The appropriate depth for burying the lower end of tubular body 12—assuring that the upper end of core 27 is positioned correctly — is indicated on the exterior of the device by means of ground-level marking 30. This is a horizontal line that shows the workman where the ground line is to be.

The upper free end of body 12 is readily adapted to have various reflector means attached thereto. In FIGS. 2 and 3, the reflector means, indicated generally at 32, comprises a horizontal plate 34 — preferably made from durable hard plastic material — provided with reflector elements 35, which are fixedly attached thereto.

However, plate 34 is secured to the flat front wall 14 by means of fasteners, such as rivets 36, which pass through plate 34, wall 14, and a structural stiffener bar 38.

Other methods can be incorporated to secure the reflector means, such as indicated in FIGS. 4 and 6 wherein the reflector elements 35 are mounted directly to the front wall and secured in place by bar 39 and rivets 40.

Even though it is not shown, it is understood that a cap or plug may be inserted in the upper open end of the body member 12 in order to close off the bore 26 — thus sealing the open end of tubular body member 12 and preventing the entry of rain, snow, and other foreign material, as well as affording protection against vandalism.

The invention and its attendant advantages will be understood from the foregoing description, and it will be apparent that various changes may be made in the form, construction and arrangement of the parts of the invention without departing from the spirit and scope thereof or sacrificing its material advantages, the arrangement hereinbefore described being merely by way of example, and I do not wish to be restricted to the specific form shown or uses mentioned except as defined in the accompanying claims.

I claim:

1. A guidepost structure, the combination comprising an elongated, tubular-body member of pliable plastic material, and said member having:

a front wall of substantial width;

a rear wall; and a pair of side walls having a sinusoidal configuration, said side walls integrally connecting said front and rear walls;

wherein said front wall is substantially flat throughout the length thereof, and said rear wall is semicircular throughout its length thereof;

said front wall, said side walls, and said rear wall defining a "T"-shaped, horizontal, cross-sectional configuration; and wherein said elongated tubular body includes a memory factor whereby any distortion of said walls will slowly be corrected so that they can attain their original contour.

2. A guidepost structure as recited in claim 1, wherein said tubular body member includes an annular flange member integrally formed at the lower terminated end thereof.

3. A guidepost structure as recited in claim 2, wherein said front wall forms a head portion of said "T"-shaped configuration, and said side walls and rear wall define a base portion thereof.

4. A guidepost structure as recited in claim 3, wherein said sinusoidal side walls comprise:

a convexed portion contiguously joined to said front wall; and a concaved portion contiguously joined to said rear semi-circular wall whereby an accordion-type folding is effected when said tubular body is subjected to impact forces from a vehicle, and wherein said body is allowed to bend without additional stress being applied thereto.

5. A guidepost structure as recited in claim 4, wherein said guidepost includes a reflector means attached to the upper end of said body.

6. A guidepost structure as recited in claim 5, wherein said reflector means comprises:

a plurality of reflector elements secured to the upper end of said body;

a securing bar member positioned within said body member; and securing means attaching said elements to said guidepost, and mounted to said securing bar member.

7. A guidepost structure as recited in claim 5, wherein said reflector means comprises:

a mounting-plate member;

a plurality of reflector elements secured to said mounting-plate member;

a securing bar member positioned within said body member; and securing means attaching said mounting plate to said guidepost and said securing bar member.

8. A guidepost structure as recited in claim 5, wherein the lower portion of said tubular-body member is filled with a core member to prevent that portion thereof from collapsing under stress when disposed within the surrounding ground medium, the core being arranged to terminate below the ground level of said ground medium.

* * * * *